US005411427A

United States Patent [19]

Nelson et al.

[11] Patent Number: 5,411,427

[45] Date of Patent: May 2, 1995

[54] BALLOON WEIGHT AND LATCH ASSEMBLY

[75] Inventors: David C. Nelson, Akron; Robert L. Waldo, Southington; Martin A. Meluch, Newton Falls, all of Ohio

[73] Assignee: Premium Balloon Accessories, Akron, Ohio

[21] Appl. No.: 52,760

[22] Filed: Apr. 26, 1993

[51] Int. Cl.[6] ..... A63H 33/00; A44B 21/00

[52] U.S. Cl. ..... 446/71; 446/220; 446/72; 24/487; 24/30.5 P

[58] Field of Search ..... 446/71-73, 446/220, 222; 24/487, 557, 17 AP, 662, 543, 30.5 P

[56] References Cited

U.S. PATENT DOCUMENTS

| | | | |
|---|---|---|---|
| 2,539,367 | 1/1951 | Greenberg | 24/557 |
| 3,600,763 | 8/1971 | Weick | 24/557 X |
| 4,038,726 | 8/1977 | Takabayashi | 24/487 X |
| 4,807,334 | 3/1989 | Blanchard | 24/487 |

FOREIGN PATENT DOCUMENTS

| | | | |
|---|---|---|---|
| 0105179 | 4/1984 | European Pat. Off. | 446/222 |
| 1277149 | 10/1961 | France | 24/487 |

*Primary Examiner*—Mickey Yu
*Attorney, Agent, or Firm*—Renner, Kenner, Greive, Bobak, Taylor & Weber

[57] ABSTRACT

A balloon weight for counterbalancing the lift of helium filled balloons and the like. The balloon weight has a molded plastic body of aesthetically pleasing appearance, with a clip or latch assembly at the top thereof. The latch assembly includes a pair of separated lobes which are adapted to be engaged within the aperture of a latch plate which is folded about a hinge and laid thereover. A receptacle is defined between the lobes for receiving a balloon ribbon or string which is then clinched between the side edges of the aperture and a base member upon which the aperture closes.

11 Claims, 2 Drawing Sheets

BALLOON WEIGHT AND LATCH ASSEMBLY

TECHNICAL FIELD

The invention herein resides in the art of ballast items. More particularly, the invention relates to balloon weights of the type employed for counterbalancing helium filled "Mylar" or foil balloons. Specifically, the invention relates to balloon weights having a clasp as an integral portion thereof, which clasp is quickly and easily employed to engage a ribbon or string of the balloon to provide secured engagement therewith.

BACKGROUND ART

Balloons are in common usage for many purposes. Balloons are commonplace at parties, in sick rooms, as a form of greeting, or simply as a novelty item. Balloon bouquets are commonplace, as is the simple securement of a balloon to a stick, string, ribbon or the like. Presently, helium filled balloons are extremely popular because they remain constantly elevated at the end of a string or ribbon. Indeed, "Mylar" or foil balloons are now commonly used for such purposes because of their attractive nature and ability to seal against leakage of the helium gas contained therein.

Typically, helium filled balloons are maintained at one end of a string or ribbon which is held at the other by an individual such as a child. If the individual releases the string or ribbon, the balloon quickly escapes retrieval by ascending into the atmosphere. Whether the balloon is of the latex or "Mylar" type, such escape results in a loss of the balloon and a hazard to the environment, since neither are biodegradable. Additionally, "Mylar" and foil balloons are electrically conductive and, if they come into contact with electrical wires or the like, can cause electrical shorts, sparking, arcing, and the like. For this reason, some governmental agencies have imposed regulations which require that "Mylar" or foil balloons have a counterbalance weight at the end of the associated ribbon such that the balloon will not escape to the atmosphere in the event that the ribbon is released by the individual holding it. Such weight provides a counterbalance or ballast to the balloon which is sufficient to defeat the "lift" of the helium envelope defined by the "Mylar" or foil balloon. Accordingly, if the ribbon is released, the weight simply drops to the ground and remains there since the gravitational force upon the weight is greater than the lift of the helium envelope. Retrieval is then a simple matter.

Presently, the provision of balloon weights to prevent escapement of helium filled balloons is well known. Such balloon weights simply attached to the end of the string or ribbon of the balloon at an end opposite that of the balloon. However, tying of the string or ribbon to the weight has been found to be an extremely time consuming undertaking which often results in an unreliable securement of the weight. Previously know balloon weights have included a hole, slot, loop, or the like through which the end of the ribbon is to be passed and then tied. Not only is the same a time consuming operation which is quite objectionable at facilities where large volumes of balloons are commonly used, such as amusement parks and the like, but it has also been found that many operators are incapable of tying effective knots which do not loosen and separate through use and the passage of time. Indeed, when ribbons having slick or polished surfaces are employed, the knot routinely becomes untied as a consequence of the low coefficient of friction of the ribbon material itself.

It has further been observed that balloon weights of the past have also been complex in structure and costly to manufacture. Accordingly, there is a need in the art for a balloon weight having a simple, yet reliable, clasp for securing the end of the balloon ribbon and which may be quickly and easily employed.

DISCLOSURE OF INVENTION

In light of the foregoing, it is a first aspect of the invention to provide a balloon weight which may be quickly and easily attached to a balloon ribbon or string.

Another aspect of the invention is the provision of a balloon weight having a clasp which reliably and securedly engages a balloon ribbon or string and which is not given to accidental removal or release, and which is further not given to ease of separation by a child.

Still a further aspect of the invention is the provision of a balloon weight which is aesthetically pleasing and which includes an easily employed clip which is unobtrusive to the weight as a whole.

Still a further aspect of the invention is the provision of a balloon weight which is inexpensive to construct, not adding significantly to the cost of the balloon when the balloon and weight are sold as a unit.

Yet an additional aspect of the invention is the provision of a balloon weight which is easily removed and/or reused by adults.

Yet another aspect of the invention is the provision of a balloon weight which is conducive to implementation with state of the art molding techniques.

The foregoing and other aspects of the invention which will become apparent as the detailed description proceeds are achieved by a balloon weight, comprising: a body portion; and a latch assembly extending from an edge of said body portion, said latch being adapted to securedly engage a ribbon.

Additional aspects of the invention which will become apparent herein are attained by a weight for securing the end of a ribbon attached to a balloon, comprising: a base plate having deflectable lugs extending therefrom; a latch plate having an aperture therein for receiving said lugs; and a hinge interconnecting said base and latch plates, said lugs being received by said aperture when said latch plate is folded onto said base plate about said hinge.

DESCRIPTION OF DRAWINGS

For a complete understanding of the objects, techniques, and structure of the invention, reference should be made to the following detailed description and accompanying drawings wherein.

BEST MODE FOR CARRYING OUT THE INVENTION

Figure 1:
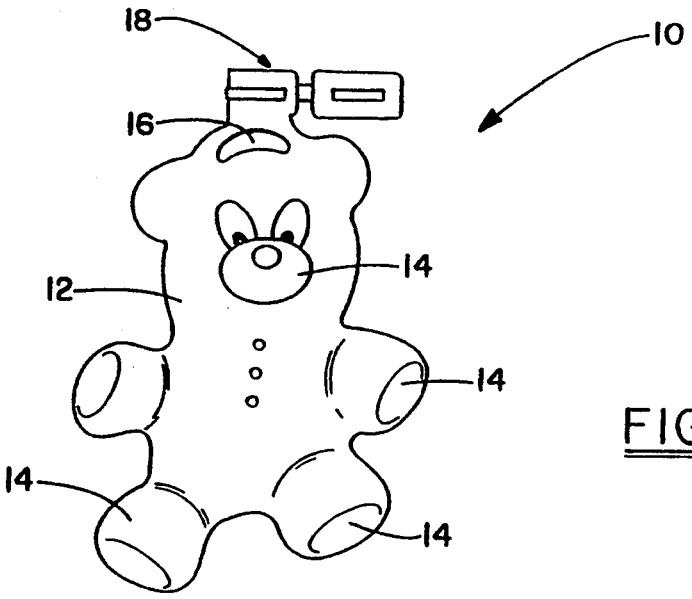
FIG. 1 is a top plan view of a balloon weight made according to the invention.

Referring now to the drawings and more particularly FIG. 1, it can be seen that a balloon weight according to the invention is designated generally by the numeral 10. The balloon weight 10 includes a molded plastic body 12 provided in an aesthetically pleasing configuration. In the embodiment shown, the body 12 is configured in the shape of a "teddy bear," although the same may be provided in the form of rabbits, chickens, or any other configurations deemed pleasing to the ultimate user. The plastic body 12 is provided with raised areas 14 to attain a three dimensional effect. In the embodiment shown, the arms, legs, nose, and the like are each defined as a raised area 14 to provide a realistic effect. An aperture or slot 16 is provided near the top of the body portion 12 for receipt of the balloon ribbon or string in a manner which will be discussed below.

Molded as an integral portion of the balloon weight 10, and as an important feature thereof, is a clip or latch assembly 18. As will become apparent below, the latch assembly 18 is adapted to quickly, easily, and securedly engage a balloon ribbon or string to allow the balloon weight 10 to serve as a counterbalance or ballast for the balloon connected to the opposite end of the ribbon or string.

Figure 2:
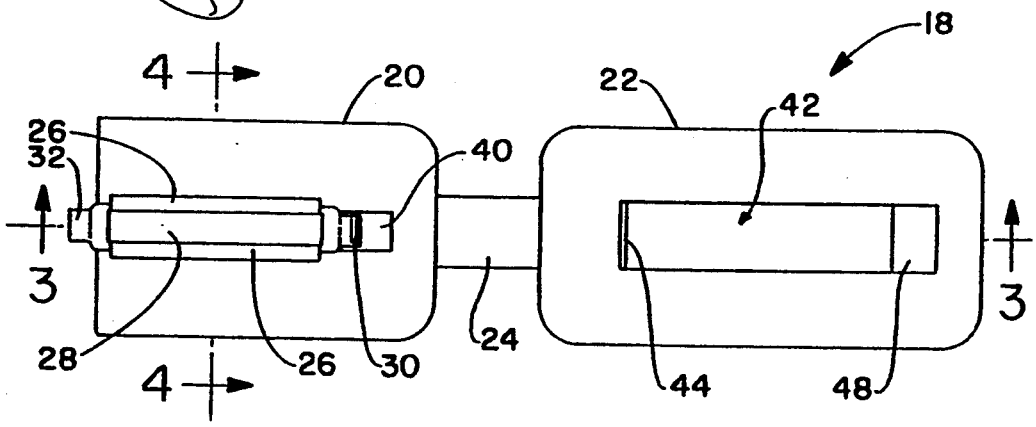
FIG. 2 is a top plan view of the latch assembly of the balloon weight of FIG. 1.
Figure 3:
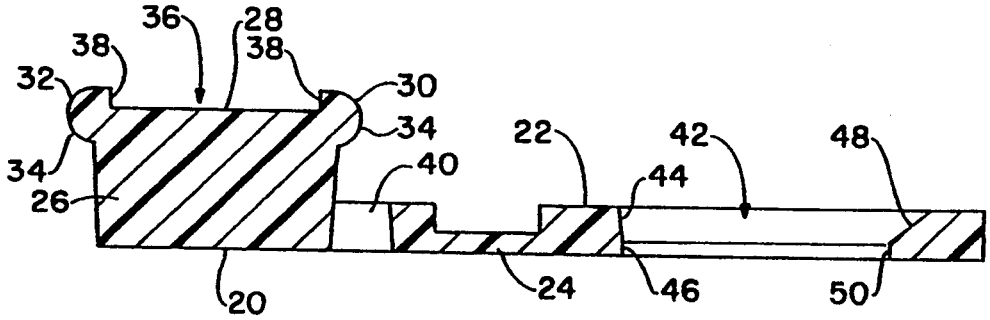
FIG. 3 is a cross sectional view of the latch of FIG. 2 taken along the line 3—3.
Figure 4:
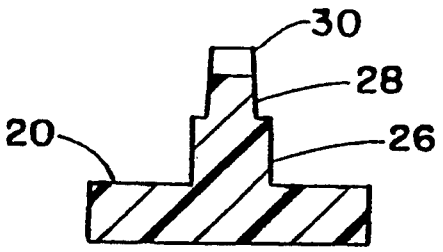
FIG. 4 is a cross sectional view of the latch of FIG. 2 taken along the line 4—4.

With reference now to FIGS. 2–4, it will be seen that the clip or latch assembly 18 includes a base plate 20 which is directly attached to and extends from the molded plastic body portion 12. A mating latch plate 22 is connected to the base plate 20 through a hinge 24. Those skilled in the art will readily appreciate that the hinge 24 consists of a thin flexible web of plastic material of the type often referred to as a "living hinge." The hinge 24 allows the latch plate 22 to be folded onto the base plate 20 to effectuate the latch in a manner which will become apparent below.

An elongated base member 26 extends from one edge of the base plate 20 centrally therealong. A center bar 28 extends outwardly from the elongated base member 26. As shown, the center bar 28 extends substantially the entire length of the base member 26, but is of lesser width.

Extending from each of the opposite ends of the center bar 28 are respective lobes 30, 32. Each of the lobes 30, 32 has a respective radiused outer surface 34, as best shown in FIG. 3. As also shown there, a receptacle 36 is defined by the top surface of the center bar 28 and between the vertical inner side edges 38 of the oppositely disposed lobes 30, 32. In the preferred embodiment of the invention, and for purposes which will become apparent below, the receptacle 36 preferably has a length substantially equal to the width of a balloon ribbon to be received thereby.

An aperture 40 is provided in the base plate 20 at an inner end of the elongated base member 26, the same being formed therein to facilitate molding operations. It has also been found that the aperture 40 may also serve to provide strain relief.

As shown in FIG. 2, the latch plate 22 is characterized by an elongated aperture or window 42. A tapered surface 44 is provided at an end of the window 42 closest to the hinge 24. As best shown in FIG. 3, the tapered surface 44 extends to a vertical surface 46 which defines an orthogonal intersection with an outer exposed planar surface of the latch plate 22. The opposite end of the window 42 is characterized by a tapered surface 48 which also extends to a vertical surface 50 which makes similar orthogonal interconnection with the outer planar surface of the latch plate 22. It will be readily appreciated that the tapered surface 44 is angled from the vertical significantly less than the surface 48. In the preferred embodiment of the invention, the tapered surface 44 is angled from the vertical on the order of 6°–15°, and preferably 8.1°. . . The tapered surface 48 is angled from the vertical on the order of 45°–65°, and preferably 54.1°. These tapered surfaces facilitate employment of the latch assembly 18, as will be apparent below.

In use, the end of a balloon string or ribbon opposite that attached to a balloon is laid across the receptacle 36, with the loose end thereof placed through the aperture 16. The latch plate 22 is then folded about the hinge 24 onto the base plate 20. During this operation, the tapered surface 44 first engages the radiused surface 34 of the lobe 30. As rotation of the latch plate 22 continues, the tapered surface 48 engages the radiused surface 34 of the opposite lobe 32. As closure continues, forceful engagement between the tapered surface 48 and the radiused outer surface 34 of the lobe 32 urges the vertical surface 46 beneath the lobe 30 with the vertical surface 50 finally coming to rest beneath the lobe 32. It will be appreciated that, to facilitate this closure, the thickness of the latch plate 22 is less than the separation between the bottom edges of the lobes 30, 32 and the top surface of the base plate 20. Accordingly, the latch plate 22 nests securely upon the base plate 20 and beneath the lobes 30, 32.

It will further be appreciated that the window 42 is substantially congruent with the elongated base member 26, with sufficient clearance therebetween to accommodate closure and to compressively engage the ribbon or string therebetween. It will further be appreciated that the center bar 28 is narrower than the window 42 such that the window can easily be passed over the lobes 30, 32 and center bar 28 during the closure operation. With the window 42 receiving the lobe 30 and a portion of the center bar 28, centering of the window 42 upon the elongated base member 26 is substantially automatically attained.

Figure 5:
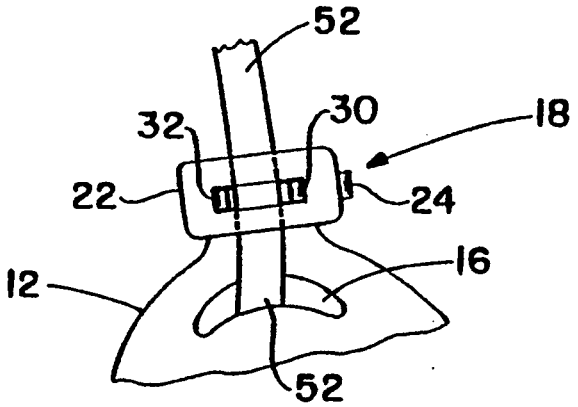
FIG. 5 is an illustrative view of the latch assembly of the balloon weight of the invention in engagement with a balloon ribbon.

As shown in FIG. 5, the ribbon 52 is grippingly received by the clip or latch assembly 18, with the loose end thereof being received through the aperture 16 and along the back side of the molded plastic body portion 12. Accordingly, the ribbon 52 does not obscure the aesthetics of the body portion 12.

It has been found that by providing the tapered surface 48 at a greater angle than the surface 44, deflection of the latch plate 22 and lobes 30, 32 is readily effectuated to achieve the latching technique. The surface 48 deflects the lobe 32 and also serves to urge the aperture 42 over the lobe 30 during closure, bringing the vertical surface 46 to rest at its locked position beneath the lobe 30.

It has also been found that with the window 42 having a clearance with the elongated base member 26 which is substantially equal to, but less than the thickness of the balloon ribbon or string, the string is pinched between the edges of the aperture 42 and the elongated base member 26 and held securely thereby. It has further been found that the latch 18 may be reopened such that the balloon ribbon 52 may be removed. However, while such reopening is a simple matter for adults and older children, it is a sufficiently difficult matter that young children cannot easily remove the balloon weight 10 from the ribbon 52. The short height of the vertical surface 50 facilitates deflection of the lobe 32 when the latch assembly 18 is opened as by rotating the latch plate about the hinge 24. Of course, the entirety of the balloon weight 10, including the latch assembly 18 is of a flexible soft plastic and the weight 10 is of sufficient size and mass to provide a desired weight.

Thus it can be seen that the objects of the invention have satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A balloon weight, comprising:

a body portion; and a latch assembly extending from an edge of said body portion, said latch assembly being adapted to securedly engage a ribbon, said latch assembly comprising a base plate, a latch plate, and a hinge interconnecting said base and latch plate, said base plate having a pair of deflectable lugs thereon and said latch plate having a window therein, said window securedly receiving said lugs when said latch plate is folded onto said base plate about said hinge, said deflectable lugs extending from opposite ends of a bar interconnected with said base plate, and said bar being received by a base member, said bar having a lesser width than said base member.

2. The balloon weight according to claim 1, wherein said bar defines a receptacle between said lugs for receiving said ribbon.

3. The balloon weight according to claim 2, wherein said window has first and second tapered surfaces disposed at opposite ends thereof.

4. The balloon weight according to claim 3, wherein said tapered surfaces taper at different angles.

5. The balloon weight according to claim 2, wherein said latch plate is maintained between said base plate and said lugs when said latch plate is folded onto said base plate about said hinge.

6. The balloon weight according to claim 5, wherein said window is substantially congruent with said base member and receives said base member when said latch plate is folded onto said base plate about said hinge, and wherein said ribbon is thereby clinched in said receptacle.

7. The weight according to claim 1, wherein said lugs have radiused outer surfaces.

8. The weight according to claim 7, wherein oppositely disposed edges of said window engage said radiused outer surfaces of said lugs and deflect said lugs when said latch plate is folded onto said base plate about said hinge.

9. The weight according to claim 8, wherein said oppositely disposed edges of said window are tapered.

10. The weight according to claim 9, wherein said edges of said window are tapered with respectively different slopes.

11. The weight according to claim 10, wherein said latch plate is secured between said lugs and said base plate and the ribbon is clinched within said receptacle when said latch plate is folded onto said base plate about said hinge.

* * * * *